US007915831B2

(12) United States Patent
Allitt et al.

(10) Patent No.: US 7,915,831 B2
(45) Date of Patent: Mar. 29, 2011

(54) GAMING MACHINE ARTWORK

(75) Inventors: Sandra Allitt, Lane Cove (AU); John Hwang, Lane Cove (AU); Cuong Dang, Lane Cove (AU); Roman Seifert, Lane Cove (AU); Troy Thompson, Lane Cove (AU)

(73) Assignee: Aristocrat Technologies Australia Pty, Ltd. (AU)

( * ) Notice: Subject to any disclaimer, the term of this patent is extended or adjusted under 35 U.S.C. 154(b) by 294 days.

(21) Appl. No.: 10/498,340

(22) PCT Filed: Jul. 28, 2003

(86) PCT No.: PCT/AU03/00948

§ 371 (c)(1),
(2), (4) Date: Dec. 2, 2004

(87) PCT Pub. No.: WO2004/012177

PCT Pub. Date: Feb. 5, 2004

(65) Prior Publication Data

US 2005/0090311 A1 Apr. 28, 2005

(30) Foreign Application Priority Data

Jul. 29, 2002 (AU) ..... 2002950569

(51) Int. Cl.
*G09G 3/10* (2006.01)

(52) U.S. Cl. ..... 315/169.3; 313/495

(58) Field of Classification Search ..... 463/7, 30, 463/43; 315/169.3; 313/495, 506; 323/235; 363/127; 345/76

See application file for complete search history.

(56) References Cited

U.S. PATENT DOCUMENTS 5,359,341 A 10/1994 Hutchings
5,412,559 A * 5/1995 Karasawa ..... 363/127
(Continued)

FOREIGN PATENT DOCUMENTS

| | | | |
|---|---|---|---|
| AU | 741427 | * | 1/1998 |
| GB | 2306746 | A | 5/1997 |
| JP | 09099134 | A | 4/1997 |
| WO | 9727576 | A1 | 7/1997 |
| WO | 9939552 | A1 | 8/1999 |

OTHER PUBLICATIONS

International Search Report, No. PCT/AU03/00948, mailing date Sep. 24, 2003, 5 pages.

*Primary Examiner* — Melba Bumgarner
*Assistant Examiner* — Masud Ahmed
(74) *Attorney, Agent, or Firm* — McAndrews, Held & Malloy, Ltd.

(57) ABSTRACT

A gaming machine artwork assembly includes a carrier on which images to be illuminated are carried. An electroluminescent illuminating arrangement is mounted on an operatively rear surface of the carrier. The electroluminescent illuminating arrangement comprises a plurality of electroluminescent elements, at least one element being associated with each image to be illuminated. A driver circuit is connected to the illuminating arrangement for driving the electroluminescent illuminating arrangement to illuminate selected electroluminescent elements of the arrangement on command from a controller of the gaming machine. The driver circuit includes individual drivers for each electroluminescent element for independently driving the electroluminescent elements and variably controlling the intensity of the illumination of the images with which said electroluminescent elements are associated.

20 Claims, 6 Drawing Sheets

U.S. PATENT DOCUMENTS 5,754,064 A 5/1998 Chien
5,814,947 A * 9/1998 Brownell ..... 315/169.3
6,027,115 A 2/2000 Griswold et al.
6,034,659 A * 3/2000 Wald et al. ..... 345/76
6,043,609 A * 3/2000 George et al. ..... 315/169.3
6,188,208 B1 * 2/2001 Glaser et al. ..... 323/235
6,225,740 B1 * 5/2001 Tucker et al. ..... 313/506
6,541,921 B1 * 4/2003 Luciano et al. ..... 315/169.3

* cited by examiner

GAMING MACHINE ARTWORK

FIELD OF THE INVENTION

This invention relates to a gaming machine. More particularly, the invention relates to a gaming machine artwork assembly and to a method of illuminating gaming machine artwork.

BACKGROUND OF THE INVENTION

Presently, to light artwork associated with a game of a gaming machine, it has been necessary to use incandescent lighting or light emitting diodes (LED's). Incandescent lights have a limited life span and, by using them, the game can lose its effectiveness by not having the artwork light up as required.

The intensity of incandescent lights or LED's cannot easily be adjusted nor adjusted sufficiently rapidly to give a realistic impression of the events occurring in the game. As a result, when it is necessary to change lighting intensity or to light up a component or image of the artwork, in response to an event in the game, this cannot be easily achieved within the required time span.

It will also be appreciated that the artwork comprises numerous images each of which may require separate illumination. To effect back lighting of these images by using incandescent lights or LED's, shielding in the form of metal or plastics formwork needs to be applied about each image to inhibit light leakage. The shielding has to be accurately mounted to match the artwork images. Any mismatch or out of tolerance mounting of the shielding causes overlapping with other images of the artwork or, in the case of finer images, lighting the wrong image altogether. The requirement to make use of shielding has also made it extremely difficult to light irregular, odd shapes or fine images.

Australian Patent No 741427 (International Publication No WO 99/39552) in the name of Screen Sign Arts Limited entitled "Electroluminescent display" discloses the use of electroluminescent material for illumination purposes. The contents of Australian Patent No 741427 are specifically incorporated in this specification by reference. The applicant proposes use of an electroluminescent illuminating arrangement.

SUMMARY OF THE INVENTION

According to a first aspect of the invention, there is provided a gaming machine artwork assembly which includes:

a carrier on which images to be illuminated are carried;

an electroluminescent illuminating arrangement mounted on an operatively rear surface of the carrier, the electroluminescent illuminating arrangement comprising a plurality of electroluminescent elements, at least one element being associated with each image to be illuminated; and a driver circuit connected to the illuminating arrangement for driving the electroluminescent illuminating arrangement to illuminate selected electroluminescent elements of the arrangement on command from a controller of the gaming machine, the driver circuit including individual drivers for each electroluminescent element for independently driving the electroluminescent elements and variably controlling the intensity of the illumination of the images with which said electroluminescent elements are associated.

The carrier may be a planar sheet of material on which the images are carried. The sheet may be a sheet of plastics material.

Each element of the electroluminescent illuminating arrangement may comprise, as described in Australian Patent No 741427, a pair of electrodes sandwiching a dielectric layer and a phosphor layer, a first, operatively front electrode being mounted to the rear surface of the carrier. The front electrode may be of a transparent material and, conveniently, may be in the form of an indium tin oxide layer. The phosphor layer may be carried on a rear surface of the front electrode and is at least partially encapsulated by the dielectric layer. A second, rear electrode may be arranged on top of the dielectric layer to form a structure having a capacitive impedance.

When an alternating voltage is applied across the electrodes, a time-varying electric field is generated in the phosphor layer and the dielectric layer. Electroluminescence occurs in the element by exciting atoms of the phosphor layer by means of the electric field. When the excitation of the atoms is removed, decay to a ground state of the atoms occurs via the emission of radiant energy in the visible spectrum resulting in illumination by the electroluminescent element.

As indicated above, the driver circuit may include a driver associated with each electroluminescent element.

The driver circuit may include a control device. The control device may be a dedicated microprocessor executing proprietary software for individually controlling each driver. The driver associated with each electroluminescent element of the artwork may be mapped to a memory location of the microprocessor and may be illuminated on command from the controller of the gaming machine.

The microprocessor may employ a modulation technique for controlling the intensity of illumination of each electroluminescent element. The modulation technique employed may be a pulse width modulation (PWM) technique.

The electroluminescent element may be driven by means of an AC signal. Typically, the AC signal has a frequency of about 500 to 1,000 Hz, preferably, about 600 to 900 Hz and, optimally, about 800 Hz.

Each driver may include a zero voltage detector circuit which detects a zero crossing of each cycle of the AC signal. For lower intensity, the AC signal may be turned off on the zero crossing for a predetermined number of cycles to obtain the required intensity of illumination. It will be appreciated that, due to the frequency of the AC signal, even if the signal is turned off for a number of cycles, it will be undetectable by the human eye and the likelihood of observing flicker is small.

For maximum intensity, the signal may not be turned off for any number of cycles. For zero illumination, the signal remains off and, for an intermediate intensity, the signal may be turned off for the appropriate number of cycles.

Assuming eight levels of illumination from zero intensity to maximum intensity, seven cycles of the AC signal are used, zero intensity having no signal. The number of levels could be increased or decreased depending on the number of cycles used. The electroluminescent elements are capacitive in nature, resulting in the AC current signal leading the AC voltage signal by 90°. Therefore, the zero voltage detector may detect a zero crossing of the voltage signal and, from that, determine or calculate a maximum or peak voltage of the AC voltage signal to determine the zero crossing of the associated AC current signal. In the case of half intensity, the driver circuit may, therefore, turn on at a maximum voltage of a first cycle of the AC voltage signal, turn off at a maximum voltage of the fourth cycle and, to commence the next period of illumination, turn on again at a maximum voltage of the eighth cycle.

The artwork may be arranged in a top box and/or on a belly board of the gaming machine. Additionally, artwork, in accordance with the invention, may be included in tower-like components, known as "traffic lights", on one or both sides of a monitor of the gaming machine. The "traffic lights" may be mounted on a door of the gaming machine. Due to the light weight of the artwork of the invention, no major structural alterations to the door are required.

According to a second aspect of the invention, there is provided a method of illuminating gaming machine artwork, the method including the steps of:

providing a carrier on which images to be illuminated are carried;

illuminating selected images on the carrier on command from a controller of the gaming machine by means of electroluminescent elements of an electroluminescent illuminating arrangement mounted on an operatively rear surface of the carrier; and controlling the intensity of illumination of the electroluminescent elements to control the intensity of illumination of the images.

Each electroluminescent element may have a driver associated with it and the method may include driving each electroluminescent element independently via its driver to control the intensity of illumination of the image associated with that element independently of each other image.

The driver associated with each electroluminescent element of the artwork may include a microprocessor and the method may include mapping to a memory location of the microprocessor the driver associated with each electroluminescent element of the artwork and illuminating the electroluminescent element of each selected image on command from the controller of the gaming machine.

The method may include using a modulation technique for controlling the intensity of illumination of each electroluminescent element.

Further, the method may include driving each electroluminescent element by means of an AC signal.

The method may include detecting a zero crossing of each cycle of the AC signal. For lower intensity illumination, the method may include turning off the AC signal on the zero crossing for a predetermined number of cycles to obtain the required intensity of illumination.

The method may include detecting a zero crossing of an AC voltage signal and, from that, determining a peak voltage of the AC voltage signal to determine the zero crossing of an associated AC current signal.

According to yet a further aspect of the invention, there is provided a gaming machine which includes a carrier carrying artwork associated with a game of the gaming machine; and an electroluminescent illuminating arrangement arranged behind the carrier for illuminating images of the artwork on command from a controller of the gaming machine.

BRIEF DESCRIPTION OF THE DRAWINGS

The invention is now described, by way of example, with reference to the accompanying diagrammatic drawings in which.

DETAILED DESCRIPTION OF THE DRAWINGS

Figure 1:
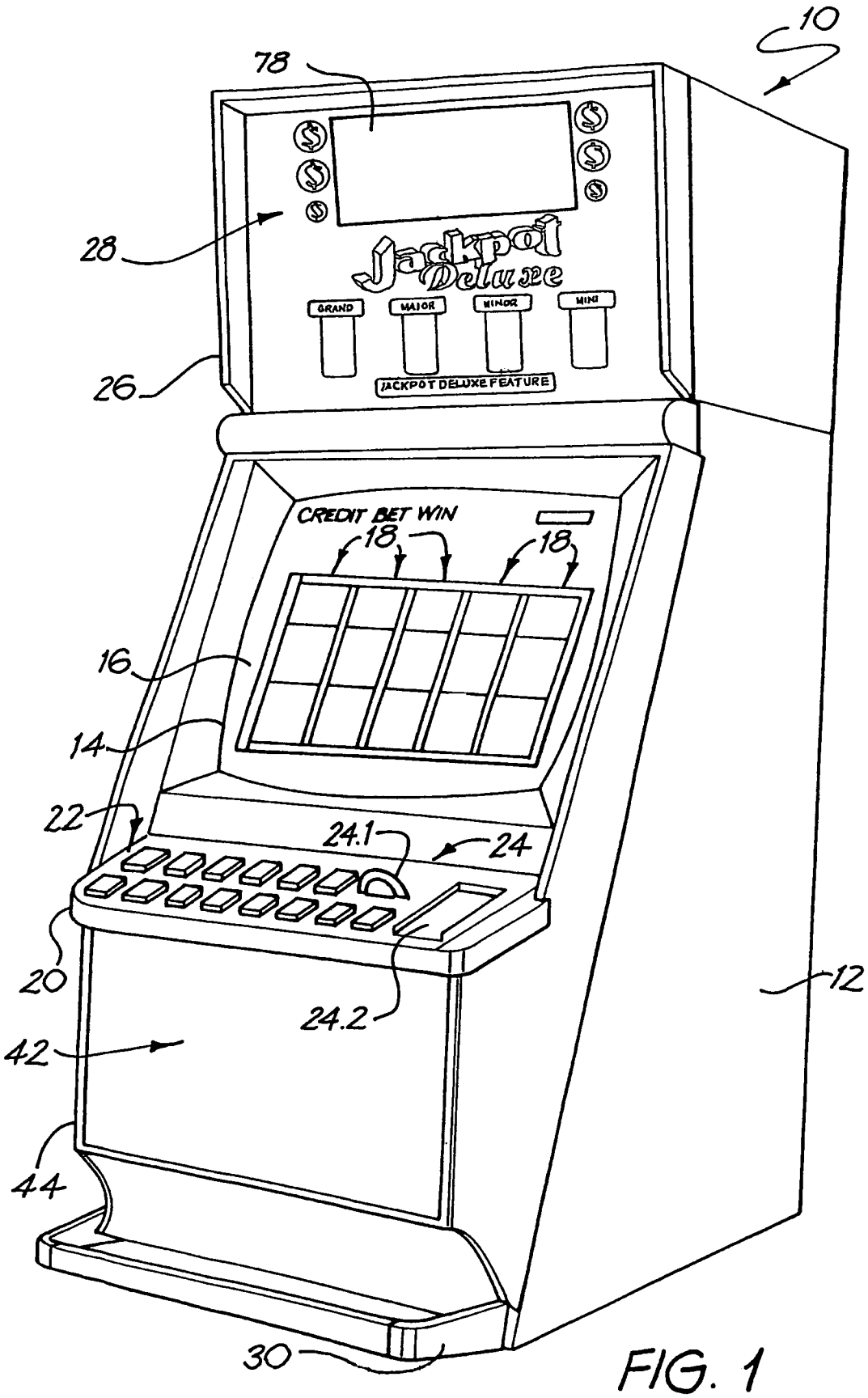
FIG. 1 shows a three dimensional view of a gaming machine, in accordance with an embodiment of the invention.

In FIG. 1, reference numeral 10 generally designates a gaming machine in accordance with an embodiment of the invention. The machine 10 includes a console 12 having a video display unit 14 on which a game 16 is played, in use. The game 16 may, for example, be a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28, in accordance with an embodiment of the invention, is carried. The artwork 28 includes images related to the game 18. Further artwork 42, which, desirably, is also in accordance with an embodiment of the invention, is carried on a belly board 44 of the gaming machine 10.

A coin tray 30 is mounted beneath the console 12 for cash payouts from the machine 10.

Figure 2:
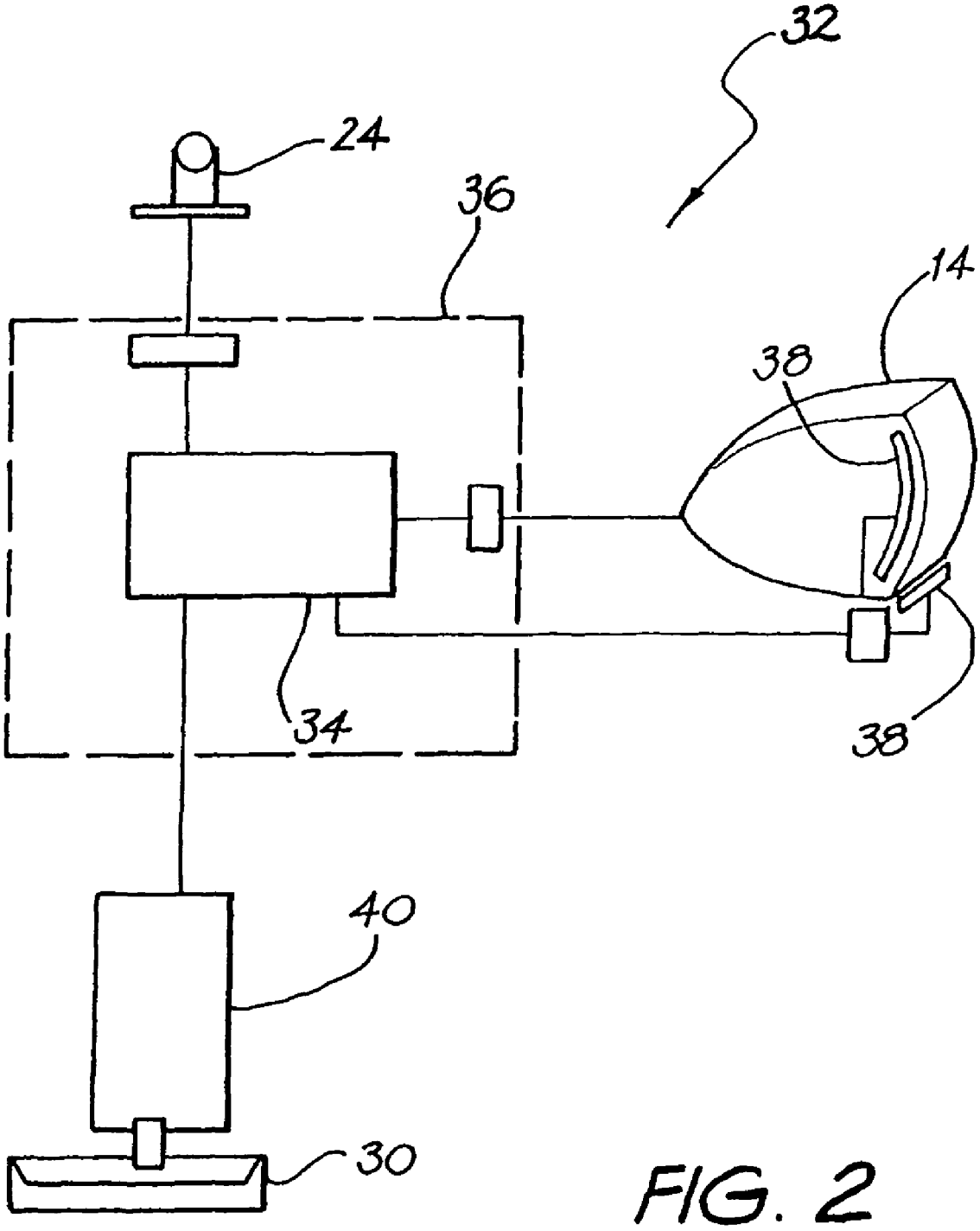
FIG. 2 shows a block diagram of a control circuit of the gaming machine.

Referring now to FIG. 2 of the drawings, a control means or control circuit 32 is illustrated. A program which implements the game and user interface is run on a processor 34 of the control circuit 32. The processor 34 forms part of a controller 36 that drives the screen of the video display unit 14 and that receives input signals from sensors 38. The sensors 38 include sensors associated with the bank 22 of buttons and touch sensors mounted in the screen of the video display unit 14. The controller 36 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Still further, the controller 36 controls illumination of the artwork 28 and 42, as will be described in greater detail below.

Finally, the controller 36 drives a payout mechanism 40 which, for example, may be a coin hopper for feeding coins to the coin tray 30 to make a pay out to a player when the player wishes to redeem his or her credit.

Figure 3:
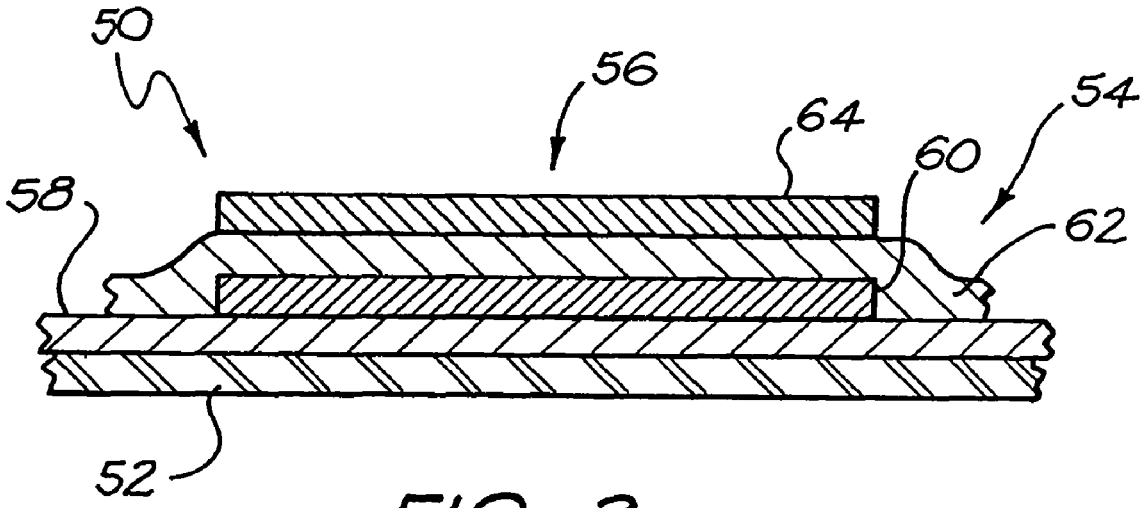
FIG. 3 shows a schematic, sectional view of a part of artwork of the gaming machine.
Figure 4:
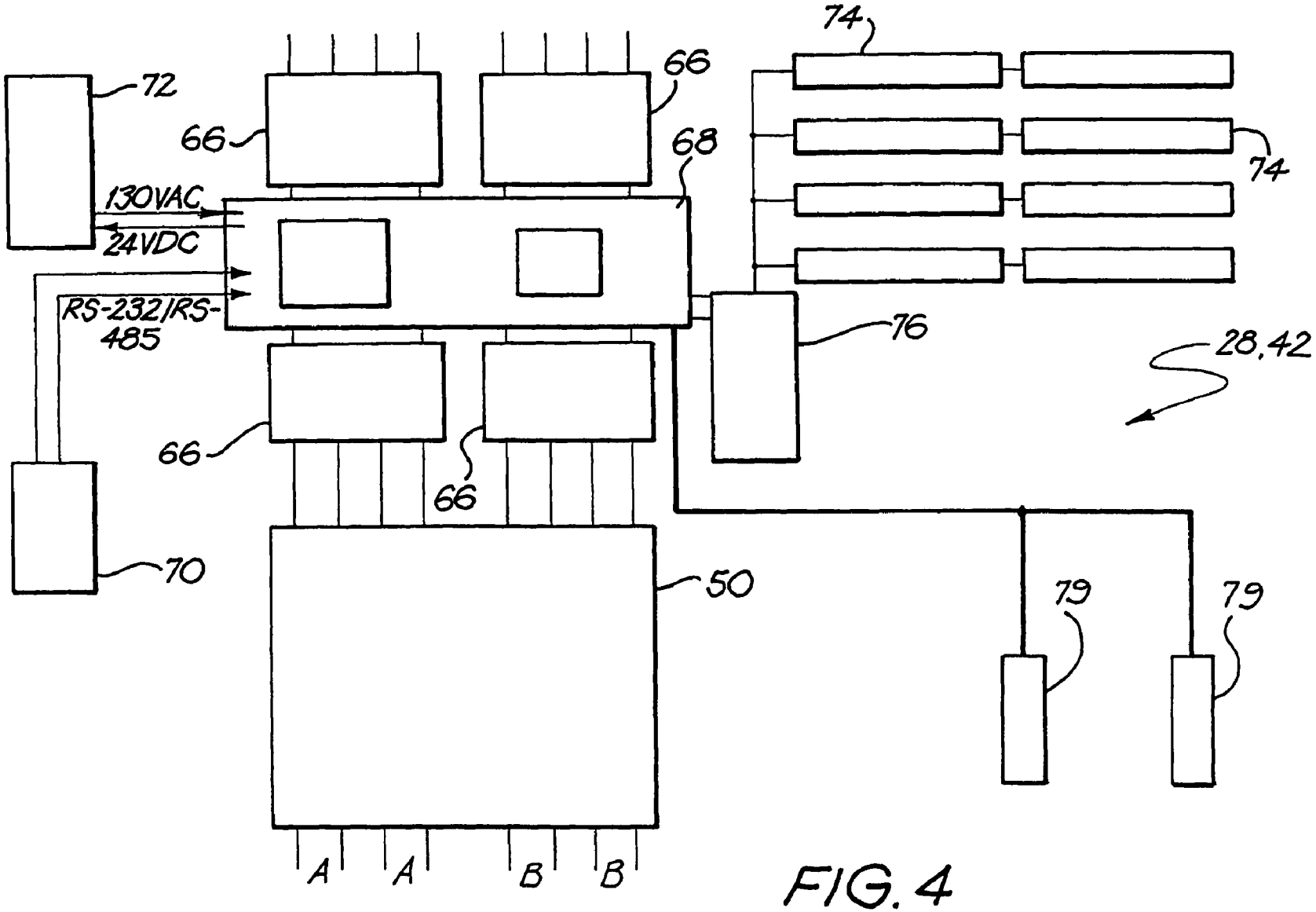
FIG. 4 shows a block diagram of control circuitry of the artwork.

Referring to FIG. 4 of the drawings, the artwork 28, 42 is described in greater detail. The artwork is represented schematically at 50 in FIG. 4 of the drawings. As shown in FIG. 3 of the drawings, the artwork 50 comprises a front carrier or panel 52 which is transparent. An electroluminescent illuminating arrangement 54 is arranged on an operatively rear surface of the panel 52. It is to be noted that the panel 52 carries images such as those shown in FIG. 7 of the drawings.

The electroluminescent illuminating arrangement 54 comprises a plurality of electroluminescent illuminating elements 56. Each image on the panel 52 has one or more elements 56 associated with it.

The electroluminescent illuminating arrangement 54 comprises a first, operatively front, transparent electrode 58. The electrode 58 covers the rear surface of the carrier 52 and is an indium tin oxide layer.

Each electroluminescent element 56 comprises, in addition, a phosphor layer 60 in the shape of the image to be illuminated. The layer 60 is applied to an operatively rear surface of the first electrode 58. The phosphor layer 60 is encapsulated in a dielectric layer 62. It is to be noted that the dielectric layer 62 overlies the phosphor layer 60 of each of the various elements 56 of the electroluminescent illuminating arrangement 54.

Finally, a second, operatively rear electrode 64 which, once again, is in the shape of the image on the panel 52 to be illuminated is applied to the dielectric layer 62 in register with its associated phosphor layer 60. The electrode 64 is of any suitable conductive material, for example, silver.

It will be appreciated that the electrodes 58 and 64, together with the dielectric layer 62 and phosphor layer 60 sandwiched between them, form a structure having a capacitive impedance. When an alternating electric field is applied to the electrodes 58 and 64, phosphorescence of the layer 60 occurs. This occurs as a result of, once the electric field has been removed, atoms in the layer 60 returning to their ground state by releasing energy which is in the visible spectrum of light.

It is also to be noted that the connection to each of the electrodes 58 and 64 have been omitted from FIG. 3 for the sake of clarity. Reference is made to Australian Patent No. 741427 where the connections are described in greater detail.

The artwork 50 is driven by one or more driver circuits 66 (FIG. 4). Each driver circuit 66, in turn, is controlled by a controller board 68. The controller board 68 receives commands from the game controller 36 via a sequencer 70. The controller board 68 receives electrical power from a high voltage power supply 72 which provides an AC signal having a frequency in the range of about 500 to 1000 Hz, preferably about 600 to 900 Hz and, optimally, about 800 Hz to the driver circuits 66.

The artwork 28, 42 also includes a plurality of light emitting diodes (LED's) arranged about a periphery of the artwork 28, 42. These LED's are commonly referred to as chaser LED's 74 which are driven by an LED driver 76 from the controller board 68. It is to be noted in FIG. 7 of the drawings that part of the image in the top box 26 of the artwork 28 is a screen 78. The screen 78 is an LED screen and displays jackpot amounts for a mini, minor, major and grand jackpot associated with the applicant's game 18, Jackpot Deluxe. The LED's of the screen 78 are also driven by the controller board 68.

A further lighting arrangement can be mounted on the gaming machine 10 on each side of the video display unit 14. Although not shown in FIG. 1 of the drawings, a column of electroluminescent devices, commonly referred to as "traffic lights" 79 (FIG. 4), may be mounted on opposed sides of the video display unit 14. The "traffic lights" 79, being of electroluminescent construction, are relatively lightweight. As a result, the "traffic lights" 79 can be mounted on a door of the gaming machine without significant, if any, structural modification to the door being required. The "traffic lights" 79 are controlled by the controller board 68.

Figure 5:
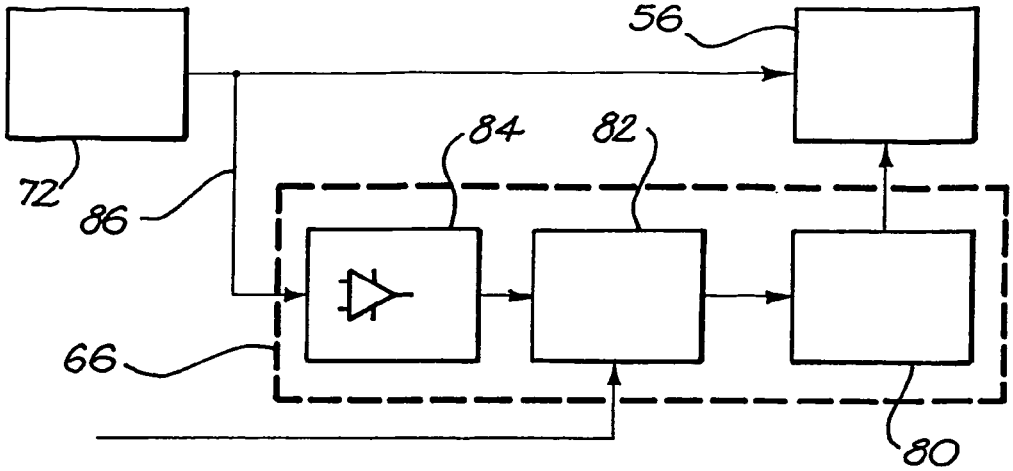
FIG. 5 shows a block diagram of a driver circuit of the control circuitry.

Referring now to FIG. 5 of the drawings, a block diagram of part of the circuitry of the artwork, including the driver circuit 66, is shown.

The driver circuit 66 includes a driver 80 for each electroluminescent element 56. Each driver 80 is controlled by a control device, in the form of a microprocessor 82, which, in turn, is controlled by the controller 36 of the gaming machine 10. The drivers 80 constitute an interface between low and high voltage circuitry of the artwork 50.

The microprocessor 82 is a dedicated unit executing proprietary software. Individual electroluminescent elements 56 of the electroluminescent illuminating arrangement 54 are mapped to memory locations of the microprocessor 82. The appropriate image of the artwork 50 is illuminated by energising the relevant electroluminescent element or elements 56 associated with that image with the required intensity of illumination as determined by the microprocessor 82 under the control of the controller 36.

Each electroluminescent element 56 is supplied with an AC signal. As indicated above, the AC signal has a frequency of, optimally, approximately 800 Hz.

To effect the required intensity of illumination of the relevant image, the AC signal is modulated by a pulse width modulation (PWM) technique.

The PWM technique employed relies on a zero crossing of cycles of an AC current signal. For this purpose, the driver circuit 66 includes a zero voltage detector 84. An AC voltage signal is supplied from the AC power supply 72 to the driver circuit 66 on a line 86. The AC voltage signal fed to the driver circuit 66 on line 86 is shown at 88 in FIG. 6 of the drawings.

The zero voltage detector 84 detects the zero crossing of the AC voltage signal 88. From that, the detector 84 determines the position of the peak of each voltage cycle of the signal 88 using the frequency of the signal 88. Because the electroluminescent elements 56 are capacitive in nature, a current signal, an example of which is shown at 90 in FIG. 6 of the drawings, supplied to the artwork 50, leads the voltage signal 88 by 90°. Having determined the position of the peak voltage of each cycle of the signal 88, the zero voltage detector 84 is able to determine the zero crossing position of each cycle of the AC current signal 90 as it is in phase with the peak voltage of each cycle of the signal 88.

Figure 6:
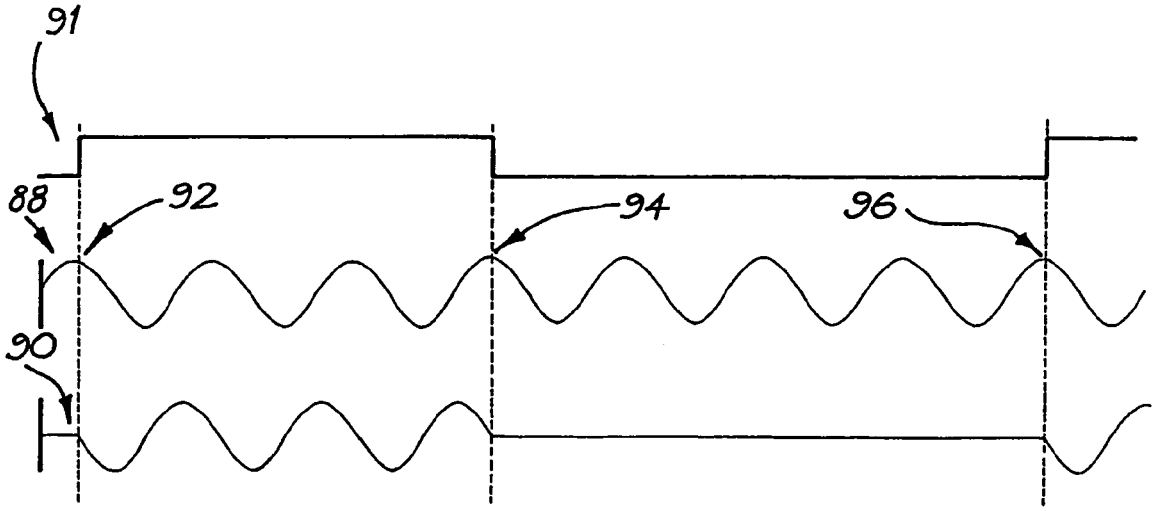
FIG. 6 shows examples of waveforms of signals in the circuit of FIG. 5.

The processor 82 of the driver circuit 66 issues a control signal 91 as shown in FIG. 6 of the drawings under the control of the controller board 68 or sequencer 70, as the case may be. The signal 91 is input to a gate of a triac (not shown) of the relevant driver 80 of the driver circuit 66 which connects the electroluminescent element 56 associated with that driver 80 to ground causing the current signal 90 to be supplied by the driver 80 to the relevant electroluminescent element 56 of the artwork 50.

It is assumed that, for full intensity illumination, seven cycles of the signal 88 are required. The example shown in FIG. 6 of the drawings illustrates the example of an electroluminescent element 56 being illuminated at 50% intensity of illumination. The current signal 90 is output by the driver 80 to its associated electroluminescent element 56 of the artwork 50. Thus, at the input to the driver 80, the signal 91 goes high on at a maximum voltage of a first cycle 92 of the signal 88 as shown in FIG. 6 of the drawings. The signal 91 goes low at the maximum voltage of the fourth cycle 94 of the signal 88 and, to commence the next period of illumination, again goes high at the maximum voltage of the eighth cycle 96 of the signal 88 to provide a 50% illumination of the artwork 50. As indicated above, while the signal 91 is high, the current signal 90 is applied to the electroluminescent element 56 being controlled.

For various other intensities of illumination, the signal 91 goes low for longer or shorter periods of time, as the case may be. It will be appreciated that, due to the relatively high frequency of the current signal 90, observable flicker will be minimised. As each element 56 is separately controlled, it will also be appreciated that each image of the artwork 50 can be illuminated with light of the desired intensity independently of any other image of the artwork 50.

It is to be noted that, to spread the load over different cycles of the power supply 72, different electroluminescent elements 56 are turned on and off at different cycles of the AC signal 88.

Figure 7:
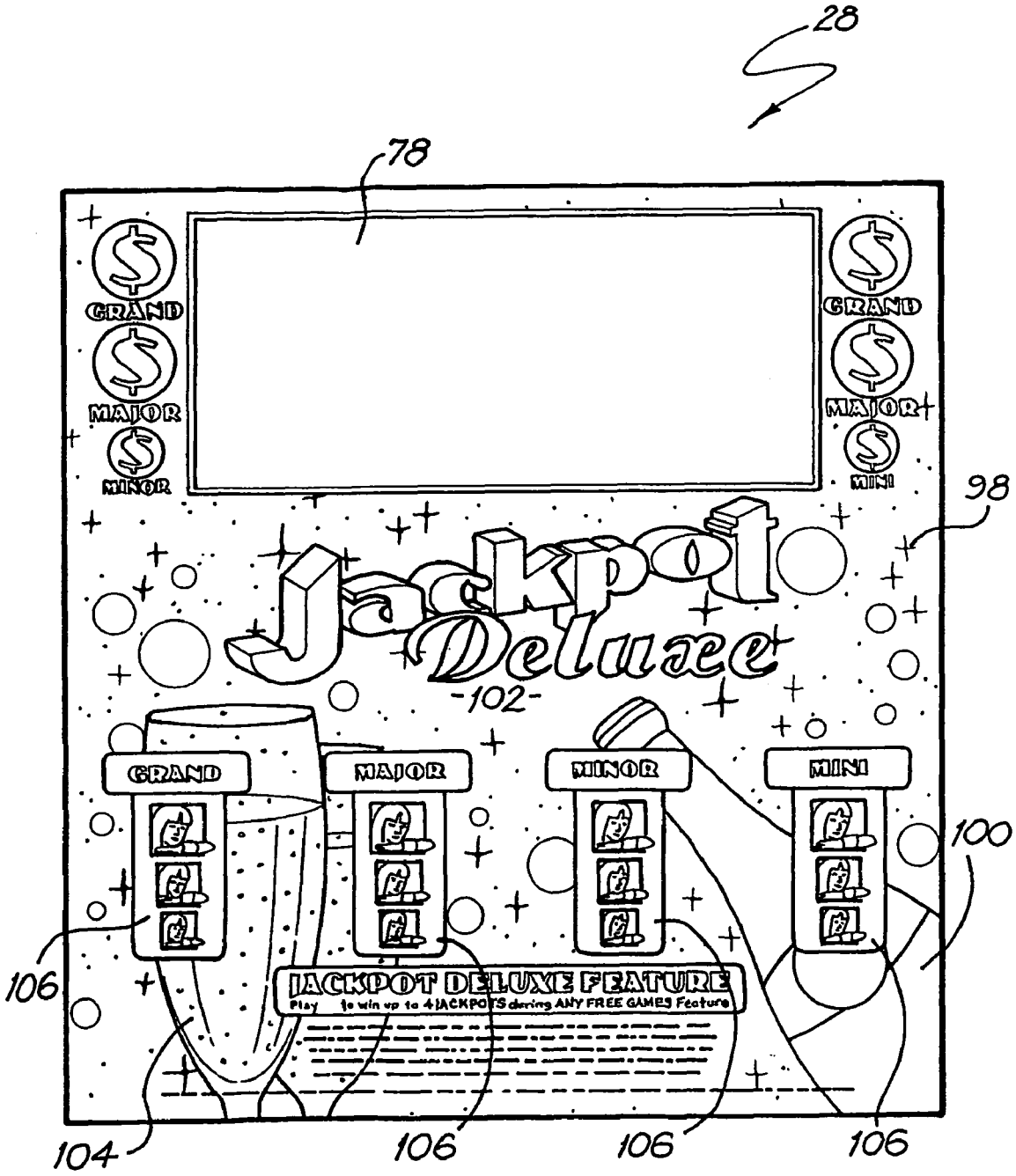
FIG. 7 shows a front view of an example of gaming machine artwork, in accordance with an embodiment of the invention.

Referring to the specific example shown in FIG. 7 of the drawings, it is to be noted that various images are displayed. Each of these images is individually illuminated by its own electroluminescent element or elements 56. Thus, for example, a star image as illustrated at 98 is illuminated by its own electroluminescent element 56. A champagne bottle 100, which may or may not be illuminated, may give the effect of champagne spouting from the bottle 100 in a region 102 of the artwork 28, the region 102 being illuminated by one or more electroluminescent elements 56.

Still further, a champagne flute 104, or parts thereof, is/are individually illuminated as are various other icons such as those indicated at 106 associated with jackpot prizes of the applicant's game Jackpot Deluxe™.

It is a particular advantage of the invention that individual elements 56 can be illuminated by means of the electroluminescent illuminating arrangement 54. The artwork 50 can comprise any number of images to be illuminated. For example, for the artwork 28 shown in FIG. 7 of the drawings, 192 individual images to be illuminated are included in the artwork 28. Each image can be illuminated separately and individually with its own intensity under the control of the microprocessor 82 and the controller 36 of the gaming machine 10 in response to particular actions in the game 16 on the gaming machine 10.

Due to the fact that each electroluminescent element 56 is constituted by layers, very fine detail can be formed in the images such as the stars 98 shown in the artwork 28 in FIG. 7 of the drawings without leakage of light or the need for metal or plastics formwork.

The benefit of switching the signal 88 at a zero crossing also results in reduced emissions and makes the design more robust.

The electroluminescent illuminating arrangement 54 is rapidly switchable so that the artwork 28 can be illuminated in real time relative to the events in the game 16.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming machine artwork assembly for use in a gaming machine having a controller, the gaming machine artwork assembly comprising:

a carrier on which images to be illuminated are carried;

an electroluminescent illuminating arrangement mounted on the carrier, the electroluminescent illuminating arrangement comprising at least one electroluminescent element associated with one of said images to be illuminated;

a generator circuit arranged to generate a full wave alternating current signal; and a driver circuit electrically connected to said generator circuit and electrically connected to the illuminating arrangement, wherein said driver circuit includes a dedicated microprocessor executing software to individually and continuously drive each of the at least one electroluminescent elements using the full wave alternating current signal in response to a pulse-width command from said controller, said driver circuit being further arranged to pulse width modulate the full wave alternating current signal based on the pulse-width command to thereby vary a cycle characteristic of the full wave alternating current signal over a period of time, so as to allow an intensity of the illumination of the image to be varied.

2. The assembly of claim 1 in which the carrier is a planar sheet of material on which the images are carried.

3. The assembly of claim 1 in which each element of the electroluminescent illuminating arrangement comprises a pair of electrodes sandwiching a dielectric layer and a phosphor layer, and wherein said pair of electrodes comprise a first, operatively front electrode being mounted to the rear surface of the carrier.

4. The assembly of claim 3 in which the phosphor layer is carried on a rear surface of the front electrode and is at least partially encapsulated by the dielectric layer.

5. The assembly of claim 3 in which said pair of electrodes comprise a second, operatively rear electrode is arranged on top of the dielectric layer to form a structure having a capacitive impedance.

6. The assembly of claim 1 in which the driver circuit includes a control device.

7. The assembly of claim 1 in which the driver circuit associated with each electroluminescent element of the artwork is mapped to a memory location of the microprocessor and is illuminated on command from the controller of the gaming machine.

8. The assembly of claim 1 in which the driver circuit includes a zero voltage detector circuit which detects a zero crossing of each cycle of the AC signal.

9. The assembly of claim 1 in which the artwork is arranged in a top box of the gaming machine.

10. The assembly of claim 1 in which the artwork is arranged on a belly board of the gaming machine.

11. The assembly of claim 1 in which artwork is included in components on one or both sides of a monitor of the gaming machine.

12. The assembly of claim 1 wherein the driver circuit generates a pulse signal of variable pulse width and uses the pulse signal to determine a number of cycles of the alternating current signal to apply to the corresponding elements.

13. A method of illuminating gaming machine artwork in a gaming machine having a controller, the method including the steps of:

providing a carrier on which images to be illuminated are carried;

illuminating selected images on the carrier on command from said controller by means of at least one electroluminescent element of an electroluminescent illuminating arrangement mounted on a rear surface of the carrier, said step of illuminating including generating a full wave alternating current signal; and varying the intensity of illumination of the images via a driver having a dedicated microprocessor executing software for individually controlling said driver, said step of varying including individually and continuously driving each of the at least one electroluminescent element using said full wave alternating current signal in response to a pulse-width command from said controller, and pulse-width modulating said full wave alternating current signal based on the pulse-width command to vary a cycle characteristics of the full wave alternating current signal over a period of time.

14. The method of claim 13 in which each electroluminescent element has a driver associated with it and in which the method includes driving each electroluminescent element independently via its driver to control the intensity of illumination of the image associated with that element independently of each other image.

15. The method of claim 14 in which the driver associated with each electroluminescent element of the artwork includes a microprocessor and the method includes mapping to a memory location of the microprocessor the driver associated with each electroluminescent element of the artwork and illuminating the electroluminescent element of each selected image on command from the controller of the gaming machine.

16. The method of claim 13 which includes detecting a zero crossing of each cycle of the AC signal.

17. The method of claim 16 wherein said modulating includes generating a pulse signal of variable width, and wherein said controlling includes determining a number of cycles of the AC signal to be applied to the corresponding electroluminescent element.

18. The method of claim 16 wherein said controlling includes detecting a zero crossing of an AC voltage signal and, from that, determining a peak voltage of the AC voltage signal to determine the zero crossing of an associated AC current signal.

19. A gaming machine comprising:

a carrier configured to carry an image of said gaming machine;

first and second electroluminescent elements supported on said carrier, and configured to illuminate said image when energized;

a power supply electrically coupled to at least one of said first and second electroluminescent elements, and to generate a full wave AC signal; and a driver electrically coupled to said illuminating elements and power supply, and including a dedicated microprocessor executing software configured to individually and continuously drive each of the first and second electroluminescent elements using the full wave AC signal, and to pulse-width modulate said AC signal to vary a cycle characteristic of the full wave AC signal over a period of time to thereby vary an intensity of the illumination of said image.

20. The gaming machine of claim 19, wherein at least one of said first and second electroluminescent elements comprises a shape of the image to be illuminated.

* * * * *